US012303093B2

(12) United States Patent
Han Yuguang et al.

(10) Patent No.: US 12,303,093 B2
(45) Date of Patent: May 20, 2025

(54) VACUUM CLEANER NOZZLE, AND VACUUM CLEANER

(71) Applicant: Electrolux Appliances Aktiebolag, Stockholm (SE)

(72) Inventors: Dennis Han Yuguang, Stockholm (SE); Gu Rain, Shanghai (CN)

(73) Assignee: Electrolux Appliances Aktiebolag, Stockholm (SE)

( * ) Notice: Subject to any disclaimer, the term of this patent is extended or adjusted under 35 U.S.C. 154(b) by 344 days.

(21) Appl. No.: 17/792,301

(22) PCT Filed: Jan. 18, 2021

(86) PCT No.: PCT/EP2021/050917
§ 371 (c)(1),
(2) Date: Jul. 12, 2022

(87) PCT Pub. No.: WO2021/144467
PCT Pub. Date: Jul. 22, 2021

(65) Prior Publication Data

US 2023/0058403 A1 Feb. 23, 2023

(30) Foreign Application Priority Data

Jan. 19, 2020 (CN) ..... 202010058866.3

(51) Int. Cl.
*A47L 9/04* (2006.01)
*A46B 13/00* (2006.01)
(Continued)

(52) U.S. Cl.
CPC ..... *A47L 9/0477* (2013.01); *A46B 13/001* (2013.01); *A46B 13/02* (2013.01);
(Continued)

(58) Field of Classification Search
CPC ..... A47L 9/0477; A47L 11/4041; A47L 9/04; A47L 11/19; A46B 13/001; A46B 13/02; A46B 2200/3033
See application file for complete search history.

(56) References Cited

U.S. PATENT DOCUMENTS

| | | | |
|---|---|---|---|
| 7,805,795 | B2 | 10/2010 | Stein et al. |
| 10,667,662 | B2 | 6/2020 | Carswell et al. |
| 2006/0064828 | A1 | 3/2006 | Stein et al. |

FOREIGN PATENT DOCUMENTS

| | | | |
|---|---|---|---|
| DE | 102017208959 | A1 | 11/2018 |
| EP | 1237459 | A1 | 9/2002 |

(Continued)

OTHER PUBLICATIONS

International Search Report and Written Opinion for International Application No. PCT/EP2021/050917, dated Apr. 6, 2021, 7 pages.

*Primary Examiner* — David Redding
(74) *Attorney, Agent, or Firm* — Bradley Arant Boult Cummings LLP

(57) ABSTRACT

A vacuum cleaner nozzle having a nozzle body and a brush roll configured to rotate relative to the nozzle body. The nozzle comprises a locking assembly having a locked state, in which the locking assembly locks the brush roll to the nozzle body, and an unlocked state, in which the locking assembly unlocks the brush roll from the nozzle body. The nozzle comprises a button, wherein the locking assembly is configured to, when in the locked state, assume the unlocked state after a displacement of the button in a first direction, and when in the unlocked state, assume the locked state after a displacement of the button in the first direction. The present disclosure further relates to a vacuum cleaner comprising a nozzle.

20 Claims, 5 Drawing Sheets

(51) Int. Cl.
*A46B 13/02* (2006.01)
*A47L 11/19* (2006.01)
*A47L 11/40* (2006.01)

(52) U.S. Cl.
CPC ..... *A46B 2200/3033* (2013.01); *A47L 11/19* (2013.01); *A47L 11/4041* (2013.01)

(56) References Cited

FOREIGN PATENT DOCUMENTS

| | | | |
|---|---|---|---|
| EP | 2106231 | A1 | 10/2009 |
| JP | 2005312589 | A | 11/2005 |
| WO | 2011158596 | A1 | 12/2011 |
| WO | 2015118981 | A1 | 8/2015 |

VACUUM CLEANER NOZZLE, AND VACUUM CLEANER

This application is a U.S. National Phase application of PCT International Application No. PCT/EP2021/050917, filed Jan. 18, 2021, which claims the benefit of Chinese Application No. 202010058866.3, filed Jan. 19, 2020, both of which are incorporated by reference herein.

TECHNICAL FIELD

The present disclosure relates to a vacuum cleaner nozzle comprising a removable brush roll unit. The present disclosure further relates to a vacuum cleaner comprising a vacuum cleaner nozzle.

BACKGROUND

A vacuum cleaner is a device that uses an air pump, most often a centrifugal fan, to create a partial vacuum at a vacuum cleaner nozzle of the vacuum cleaner in order to suck up dust and dirt from surfaces, such as floors, carpets, beds, and the like. Some vacuum cleaner nozzles are equipped with a brush roll which is rotated during operation of the vacuum cleaner. A brush roll can improve the cleaning efficiency because bristles of the brush roll can remove matter such as particles, dust, hair, and dirt by an abutting contact against the matter.

A problem associated with brush rolls is that matter may stick to the brush roll and may clog the brush roll. The matter may reduce the cleaning efficiency of the brush roll and may hinder rotation of the brush roll. Therefore, occasionally, matter such as hair must be removed from the brush roll which usually is a burdensome and time-consuming process, especially for users having long fingernails.

Some vacuum cleaner nozzles have been developed allowing a user to remove the brush roll from the vacuum cleaner nozzle. Such vacuum cleaner nozzles significantly facilitate the process of removing matter, such as hair, from the brush roll. However, problems still exist regarding user-friendliness of such nozzles. That is, many vacuum cleaner nozzles having a removable brush roll is difficult to use and may require a user to read a user's manual before use in order to be able to remove the brush roll from the vacuum cleaner nozzle. Moreover, many solutions make it hard to pull out the brush roll from the vacuum cleaner nozzle, especially when the brush roll is clogged with matter.

Furthermore, generally, on today's consumer market, it is an advantage if products, such as vacuum cleaners and vacuum cleaner components, have conditions and/or characteristics suitable for being manufactured and assembled in a cost-efficient manner.

SUMMARY

It is an object of the present invention to overcome, or at least alleviate, at least some of the above-mentioned problems and drawbacks.

According to a first aspect of the invention, the object is achieved by a vacuum cleaner nozzle comprising a nozzle body and a brush roll configured to rotate relative to the nozzle body during operation of the nozzle. The vacuum cleaner nozzle further comprises a locking assembly having a locked state, in which the locking assembly locks the brush roll to the nozzle body, and an unlocked state, in which the locking assembly unlocks the brush roll from the nozzle body for removal of the brush roll from the nozzle body. The nozzle comprises a button operably connected to the locking assembly. The locking assembly is configured to, when in the locked state, assume the unlocked state after a displacement of the button in a first direction, and when in the unlocked state, assume the locked state after a displacement of the button in the first direction.

Thereby, a vacuum cleaner nozzle is provided allowing a user to unlock the brush roll from the nozzle body in a simple and intuitive manner, simply by displacing the button in the first direction. Moreover, a vacuum cleaner nozzle is provided allowing a user to lock the brush roll to the nozzle body in a simple and intuitive manner, simply by displacing the button in the first direction. Accordingly, a vacuum cleaner nozzle is provided allowing a user to lock and unlock the brush roll using the same actuation direction of the button which provides a more user-friendly vacuum cleaner nozzle having conditions for being used in a more intuitive manner.

Thus, a vacuum cleaner nozzle is provided having conditions for facilitating the process of removing, as well as the process of fastening, the brush roll to and from the nozzle body.

Accordingly, a vacuum cleaner nozzle is provided overcoming, or at least alleviating, at least some of the above-mentioned problems and drawbacks. As a result, the above-mentioned object is achieved.

Optionally, the button is configured to assume a first position when the locking assembly is in the locked state and assume a second position when the locking assembly is in the unlocked state. Thereby, an even more user-friendly vacuum cleaner nozzle is provided. This because the position of the button can indicate the locking state of the locking assembly to a user. Moreover, the second position of the button may facilitate the process of removing the brush roll from the nozzle body also when the brush roll is clogged with matter.

Optionally, the button is located further out from the nozzle body in a second direction opposite to the first direction when the button is in the second position than when the button is in the first position. Thereby, an even more user-friendly vacuum cleaner nozzle is provided. This because the position of the button can indicate the locking state of the locking assembly to a user in a clear manner. Moreover, the second position of the button may facilitate the process of removing the brush roll from the nozzle body also when the brush roll is clogged with matter.

Optionally, the button comprises a grip surface exposed to a user when the button is in the second position. Thereby, an even more user-friendly vacuum cleaner nozzle is provided. This because the grip surface can facilitate the process of removing the brush roll from the nozzle body also when the brush roll is clogged with matter.

Optionally, the locking assembly comprises a spring member configured to bias the button in a second direction opposite to the first direction. Thereby, a consistent and reliable locking and unlocking of the locking assembly can be provided.

Optionally, the locking assembly comprises a first lock member and a second lock member, wherein the button is operably connected to one of the first and second lock members, and wherein the first lock member is configured to assume a different position relative to the second lock member after a displacement of the button in the first direction. Thereby, a consistent and reliable locking and unlocking of the locking assembly can be provided. Moreover, a locking assembly is provided having conditions and characteristics suitable for being manufactured and assembled in a cost-efficient manner.

Optionally, the first lock member comprises a first seat, a second seat and a cam profile, wherein the second lock member comprises a follower portion received in the cam profile, and wherein the cam profile is configured to move the follower portion from the first seat to the second seat when the locking assembly is in the locked state and the button is displaced in the first direction, and is configured to move the follower portion from the second seat to the first seat when the locking assembly is in the unlocked state and the button is displaced in the first direction. Thereby, a consistent and reliable locking and unlocking of the locking assembly can be provided. Moreover, a locking assembly is provided having conditions and characteristics suitable for being manufactured and assembled in a cost-efficient manner.

Optionally, the brush roll is configured to rotate around a rotation axis during operation of the nozzle, and wherein the rotation axis extends through at least a portion of the button. Thereby, a vacuum cleaner nozzle is provided which can be used in a still simpler and more intuitive manner. This because the button is positioned at the vacuum cleaner nozzle at an intuitive location which may facilitate detection of the button.

Optionally, the brush roll is configured to rotate around a rotation axis during operation of the nozzle, and wherein the first direction is substantially parallel to the rotation axis.

Thereby, a vacuum cleaner nozzle is provided which can be used in a still simpler and more intuitive manner. This because a user may lock and unlock the locking assembly simply by displacing the button in an intuitive direction being substantially parallel to the rotation axis.

Optionally, the nozzle comprises a brush roll unit comprising the brush roll, and wherein the button is arranged on the brush roll unit. Thereby, a vacuum cleaner nozzle is provided which can be used in a still simpler and more intuitive manner because a user can in a simpler and more intuitive manner remove the brush roll from the nozzle body and fasten the brush roll to the nozzle body. That is, due to these features, when a user wants to remove the brush roll from the nozzle body, the user may simply displace the button in the first direction and pull the brush roll unit out from the nozzle body for example by grabbing the button and pulling the brush roll unit in a second direction opposite to the first direction. Likewise, if the user wants to fasten the brush roll unit to the nozzle body, the user may simply insert the brush roll unit into the nozzle body and displace the button in the first direction. As a result, the locking assembly will lock the brush roll to the nozzle body.

Optionally, the nozzle comprises a brush roll unit, and wherein the brush roll unit comprises the brush roll and a housing accommodating the locking assembly. Thereby, a vacuum cleaner nozzle is provided which can be used in a still simpler and more intuitive manner because a user can in a simpler and more intuitive manner remove the brush roll from the nozzle body and fasten the brush roll to the nozzle body. Moreover, due to these features, the locking assembly may occupy little space in the vacuum cleaner nozzle, which provides conditions for an efficient utilization of the available space in the vacuum cleaner nozzle.

Optionally, the locking assembly comprises one or more locking elements configured to protrude from the housing when the locking assembly is in the locked state. Thereby, a simple and reliable locking and unlocking of the locking assembly can be provided. Moreover, a vacuum cleaner nozzle is provided having conditions and characteristics suitable for being manufactured and assembled in a cost-efficient manner.

Optionally, the substantially the entire circumference of the button is enclosed by the housing when the button is in the first position. Thereby, a vacuum cleaner nozzle is provided in which the button is less likely to bump into objects during use of the vacuum cleaner nozzle. In this manner, a more durable and user-friendly vacuum cleaner nozzle is provided.

Optionally, a first end of the brush roll is rotationally attached to the housing. Thereby, an efficient vacuum cleaner nozzle is provided and removal of the brush roll from the nozzle body may be facilitated.

Optionally, the nozzle body comprises an opening configured to accommodate the housing. Thereby, a vacuum cleaner nozzle is provided in which the housing of the brush roll unit is less likely to bump into objects during use of the vacuum cleaner nozzle. In this manner, a more durable and user-friendly vacuum cleaner nozzle is provided.

Optionally, the opening comprises one or more apertures each configured to accommodate a locking element of the locking assembly when the housing is inserted in the opening and the locking assembly is in the locked state. Thereby, a simple and reliable locking and unlocking of the locking assembly can be provided. Moreover, a vacuum cleaner nozzle is provided having conditions and characteristics suitable for being manufactured and assembled in a cost-efficient manner.

According to a second aspect of the invention, the object is achieved by a vacuum cleaner comprising a nozzle according to some embodiments of the present disclosure.

Thereby, a vacuum cleaner is provided comprising a vacuum cleaner nozzle allowing a user to unlock the brush roll from the nozzle body in a simple and intuitive manner, simply by displacing the button in the first direction. Moreover, a vacuum cleaner is provided allowing a user to lock the brush roll to the nozzle body in a simple and intuitive manner, simply by displacing the button in the first direction. Accordingly, a vacuum cleaner is provided allowing a user to lock and unlock the brush roll using the same actuation direction of the button which provides a more user-friendly vacuum cleaner having conditions for being used in a more intuitive manner.

Thus, a vacuum cleaner is provided comprising a vacuum cleaner nozzle having conditions for facilitating the process of removing, as well as the process of fastening, the brush roll to and from the nozzle body.

Accordingly, a vacuum cleaner is provided overcoming, or at least alleviating, at least some of the above-mentioned problems and drawbacks. As a result, the above-mentioned object is achieved.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
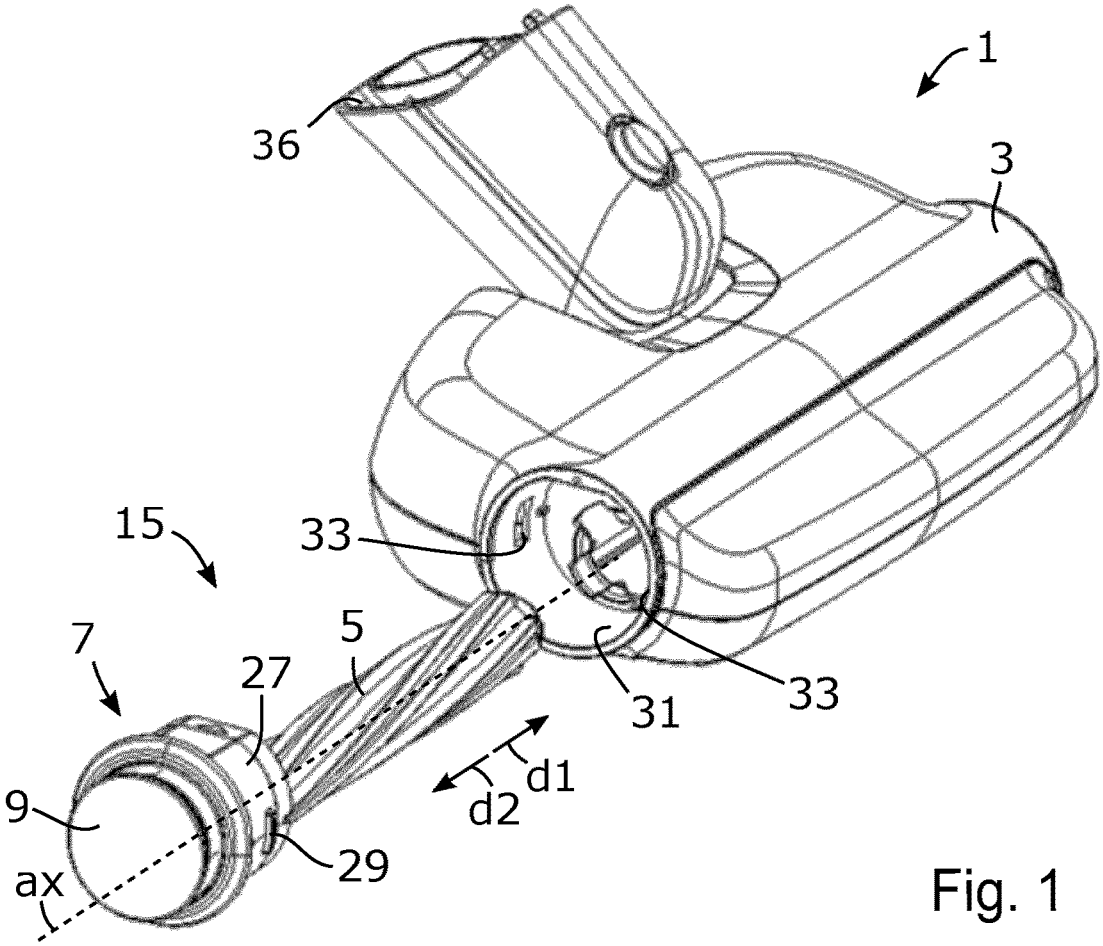
FIG. 1 illustrates a vacuum cleaner nozzle, according to some embodiments.

FIG. 1 illustrates a vacuum cleaner nozzle 1 according to some embodiments of the present disclosure. In some places herein, the vacuum cleaner nozzle 1 is referred to as "the nozzle 1". Therefore, throughout this disclosure, the wording "nozzle" may be replaced by the wording "vacuum cleaner nozzle". The vacuum cleaner nozzle 1 comprises a nozzle body 3 and a brush roll unit 15. The brush roll unit 15 comprises a brush roll 5 and a housing 27. The housing 27 accommodates a locking assembly 7, as is further explained herein. In FIG. 1, the brush roll unit 15 is illustrated as removed from the nozzle body 3.

The brush roll 5 may comprise bristles extending from a brush roll body of the brush roll 5. The brush roll 5 is configured to rotate around a rotation axis ax relative to the nozzle body 3 during operation of the nozzle 1, so as to pick up matter such as particles, dust, hair, and dirt by an abutting contact against the matter. As is further explained herein, the locking assembly 7 has a locked state, in which the locking assembly 7 locks the brush roll 5 to the nozzle body 3, and an unlocked state, in which the locking assembly 7 unlocks the brush roll 5 from the nozzle body 3 for removal of the brush roll 5 from the nozzle body 3. In FIG. 1, the locking assembly 7 is illustrated in the unlocked state.

The brush roll unit 15 further comprises a button 9 operably connected to the locking assembly 7. According to the illustrated embodiments, the button 9 is arranged on the brush roll unit 15. As seen in FIG. 1, the rotation axis ax of the brush roll 5 extends through at least a portion of the button 9. The brush roll unit 15 is insertable into an opening 31 of the nozzle body 3. The opening 31 of the nozzle body 3 is configured to accommodate the housing 27 of the brush roll unit 15 when the brush roll unit 15 is inserted into the opening 31.

Figure 2:
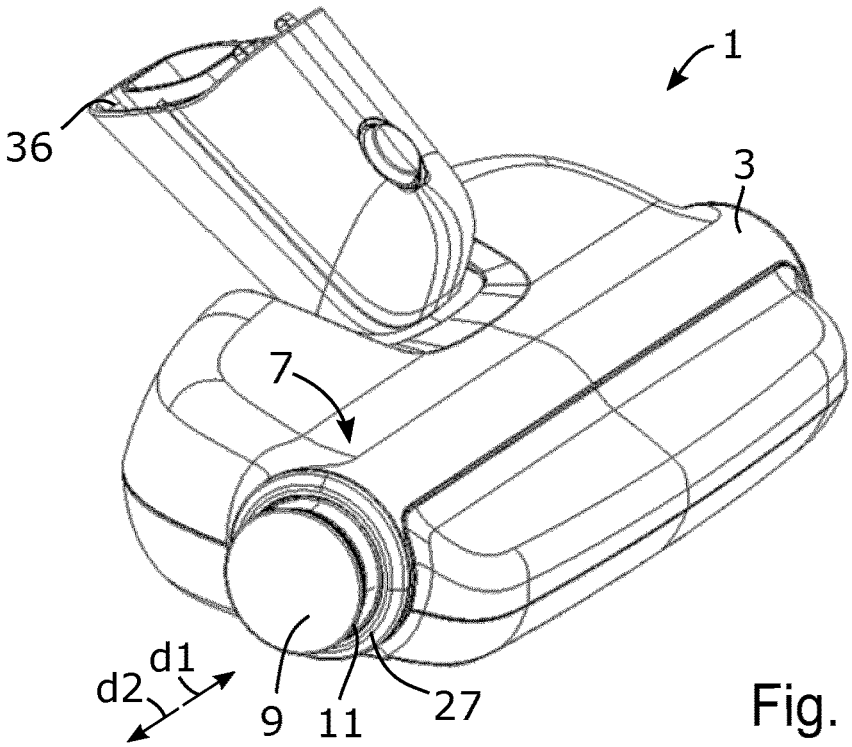
FIG. 2 illustrates the vacuum cleaner nozzle illustrated in FIG. 1, with a brush roll unit inserted into an opening of a nozzle body of the vacuum cleaner nozzle.

FIG. 2 illustrates the vacuum cleaner nozzle 1 illustrated in FIG. 1, with the brush roll unit 15 inserted into the opening of the nozzle body 3. In FIG. 2, the locking assembly 7 is illustrated in the unlocked state. As is further explained herein, the locking assembly 7 is configured to, when in the unlocked state, assume the locked state after a displacement of the button 9 in a first direction d1. In this manner, a user may attach the brush roll unit 15 in a simple and intuitive manner simply by inserting the brush roll unit 15 into the opening 31 of the nozzle body 3 and displace the button 9 in the first direction d1. As can be seen when comparing FIG. 1 and FIG. 2, the first direction d1 coincides with an insertion direction of the brush roll unit 15 into the opening 31 of the brush roll body 3. Moreover, as can be seen in FIG. 1, the first direction d1 is substantially parallel to the rotation axis ax of the brush roll 5. Due to these features, the process of attaching the brush roll unit 15 to the nozzle body 3 is significantly facilitated.

Figure 3:
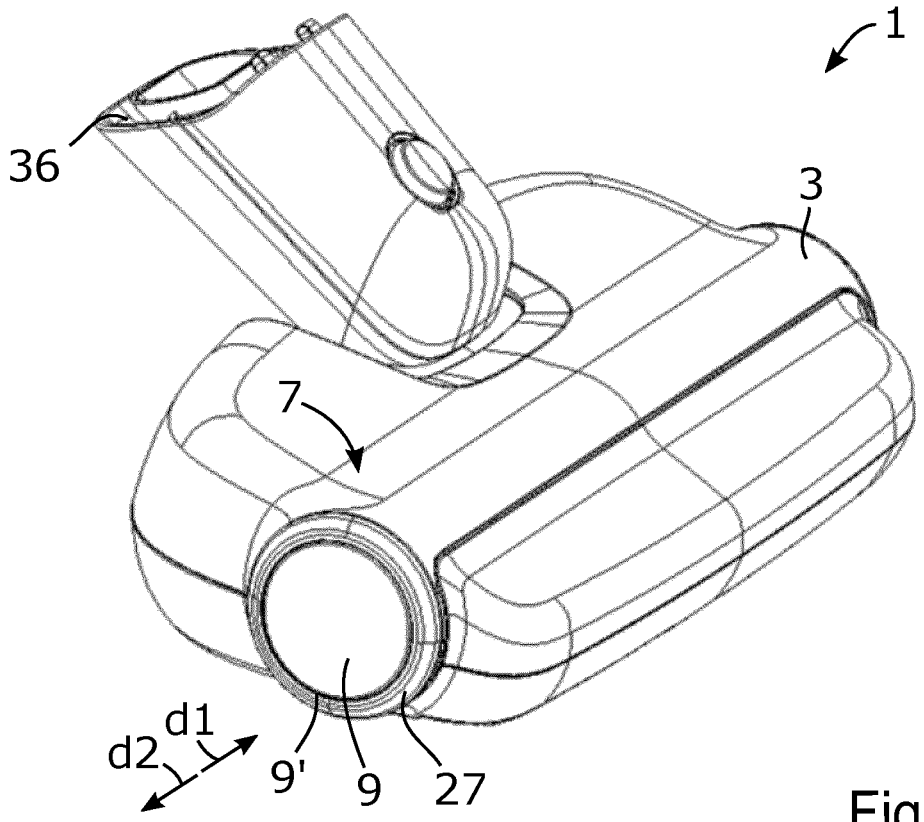
FIG. 3 illustrates the vacuum cleaner nozzle illustrated in FIG. 2, with a locking assembly in a locked state.

FIG. 3 illustrates the vacuum cleaner nozzle 1 illustrated in FIG. 2, with the locking assembly 7 in the locked state. Accordingly, in FIG. 3, the button 9 is illustrated as having been displaced in the first direction d1. The button 9 is configured to assume a first position when the locking assembly 7 is in the locked state. Thus, in FIG. 3, the button 9 is illustrated in the first position. As can be seen in FIG. 3, substantially the entire circumference 9' of the button 9 is enclosed by the housing 27 when the button 9 is in the first position. In this manner, the button 9 is less likely to bump into objects during use of the vacuum cleaner nozzle 1.

As is further explained herein, the locking assembly 7 is configured to, when in the locked state, assume the unlocked state after a displacement of the button 9 in a first direction d1. Moreover, the button 9 is configured to assume a second position when the locking assembly 7 is in the unlocked state. That is, if a user displaces the button 9 in the first direction indicated in FIG. 3, the locking assembly 7 will be transferred to the unlocked state and the button 9 will assume the second position. In FIG. 2, the button 9 is illustrated in the second position. As can be seen when comparing FIG. 2 and FIG. 3, the button 9 is located further out from the nozzle body 3 in a second direction d2, opposite to the first direction d1, when the button 9 is in the second position than when the button 9 is in the first position. Moreover, as indicated in FIG. 2, the button 9 comprises a grip surface 11 exposed to a user when the button 9 is in the second position.

Accordingly, due to these features, when the brush roll unit 15 is fastened to the nozzle body 3 and a user wants to remove the brush roll unit 15 from the nozzle body 3, a user may simply displace the button 9 in the first direction d1, for example by pressing the button 9 in the first direction d1. As a result, the locking assembly 7 will be transferred to the unlocked state and the button 9 will assume the second position, as illustrated in FIG. 2. Then the user may grip the grip surface 11 of the button 9 and may apply a force onto the brush roll unit 15 in the second direction d2 so as to pull the brush roll unit 15 out of the nozzle body 3. Accordingly, due to these features, the process of removing the brush roll unit 15 from the nozzle body 3 is significantly facilitated also when the brush roll 5 is clogged with matter.

Then, the user may in a simple and convenient manner remove matter such as particles, dust, hair, and dirt from the brush roll 5 and may then insert the brush roll unit 15 again into the opening 31 of the brush roll body 3 and press the button 9 in the first direction d1.

Figure 4:
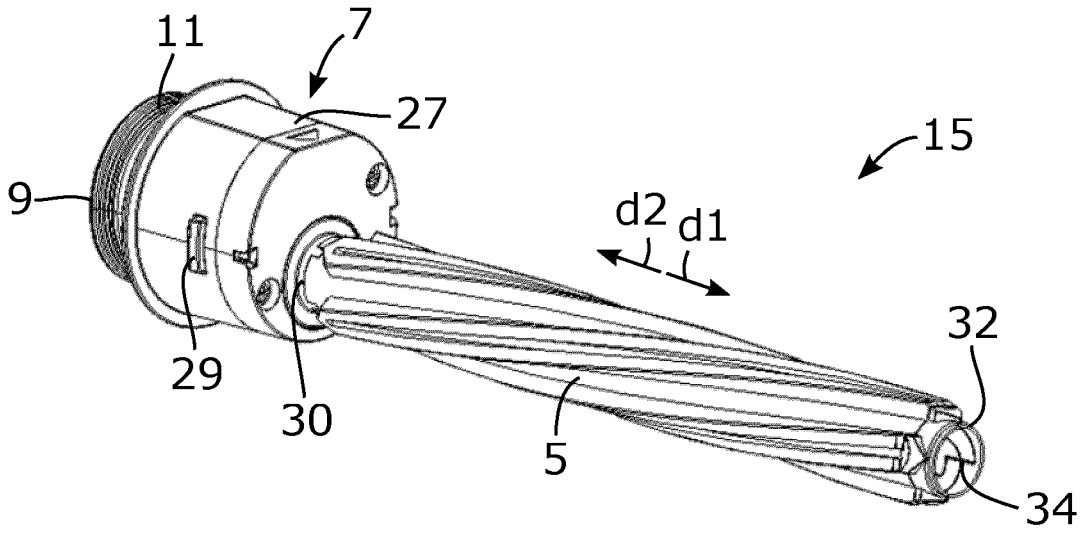
FIG. 4 illustrates the brush roll unit according to the embodiments illustrated in FIG. 1-FIG. 3.

FIG. 4 illustrates the brush roll unit 15 according to the embodiments illustrated in FIG. 1-FIG. 3. As indicated in FIG. 4, a first end 30 of the brush roll 5 is rotationally attached to the housing 27. Moreover, a second end 32 of the brush roll 5 comprises a drive shaft interface 34. According to the illustrated embodiments, the brush roll 5 is configured to be rotated by an electric motor via the drive shaft interface 34. According to further embodiments, the brush roll 5 may be configured to be rotated by another type of drive arrangement, such as a pneumatic drive arrangement. The drive arrangement may be arranged in the nozzle body of the vacuum cleaner nozzle.

In FIG. 4, the locking assembly 7 of the brush roll unit 15 is illustrated in the unlocked state and the button 9 is illustrated in the second position. The grip surface 11 of the button 9 is also indicated in FIG. 4.

Figure 5:
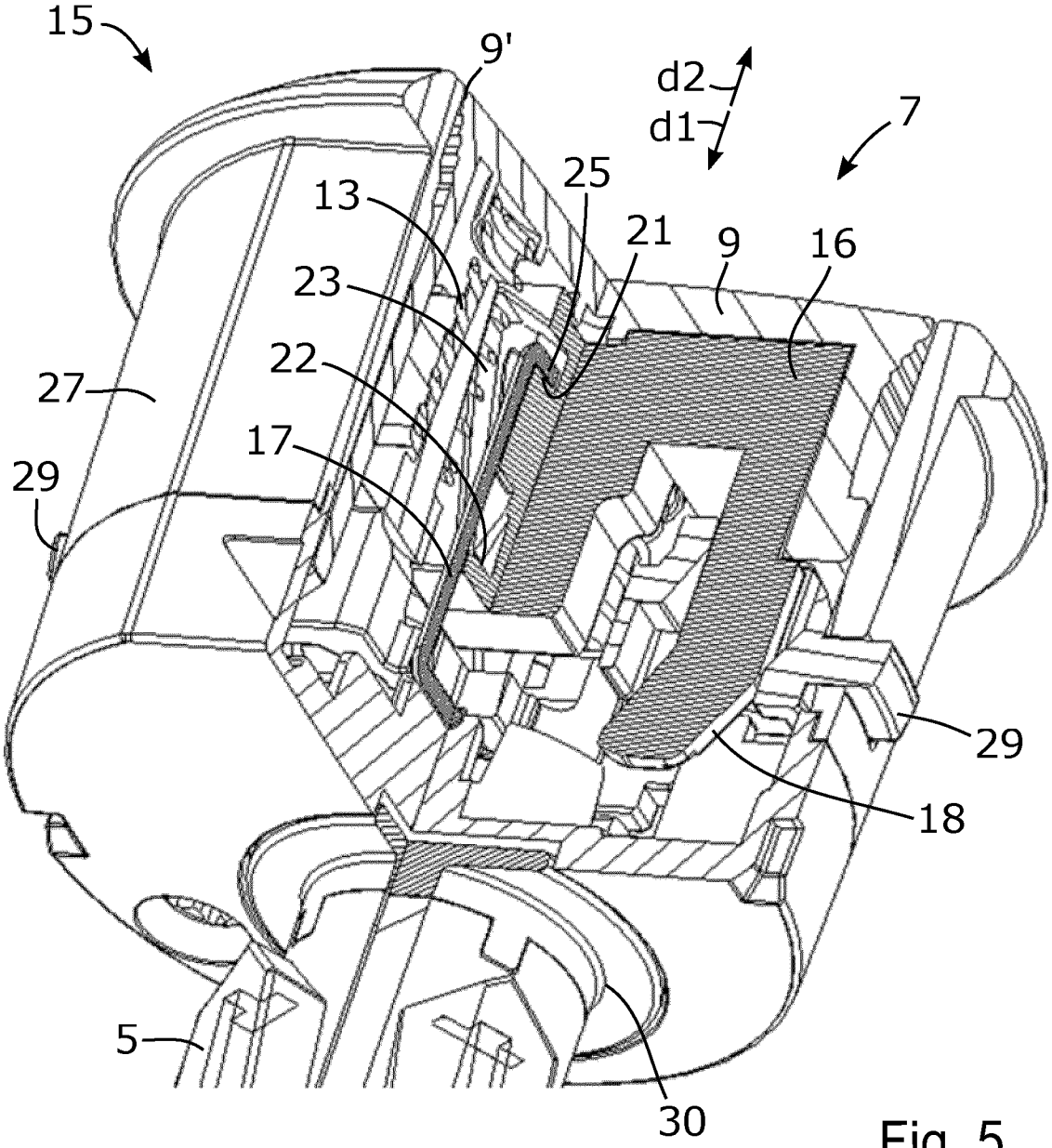
FIG. 5 illustrates an enlarged view of a brush roll unit according to the embodiments illustrated in FIG. 4 with a cross section made through a housing of the brush roll unit.

FIG. 5 illustrates an enlarged view of a brush roll unit 15 according to the embodiments illustrated in FIG. 4 with a cross section made through the housing 27 of the brush roll unit 15. In FIG. 5, the locking assembly 7 of the brush roll unit 15 is illustrated in the locked state and the button 9 is illustrated in the first position. The circumference 9' of the button 9 is also indicated in FIG. 5.

As can be seen in FIG. 5, the locking assembly 7 comprises a spring member 13 configured to bias the button 9 in a second direction d2 opposite to the first direction d1. According to the illustrated embodiments, the spring member 13 is a coil spring.

According to further embodiments, the spring member 13 may be another type of spring member, such as a leaf spring, or the like. Moreover, according to the illustrated embodiments, the locking assembly 7 comprises a first lock member 16 and a second lock member 17. The button 9 is operably connected to the first lock member 16. According to the illustrated embodiments, the button 9 is operably connected to the first lock member 16 by being attached to the first lock member 16. As is further explained herein, the first lock member 16 is configured to assume a different position relative to the second lock member 17 after a displacement of the button 9 in the first direction d1.

According to the illustrated embodiments, the first lock member 16 comprises a first seat 21, a second seat 22 and a cam profile 23. The second lock member 17 comprises a follower portion 25 received in the cam profile 23. The cam profile 23 is configured to move the follower portion 25 from the first seat 21 to the second seat 22 when the locking assembly 7 is in the locked state and the button 9 is displaced in the first direction d1.

Figure 6:
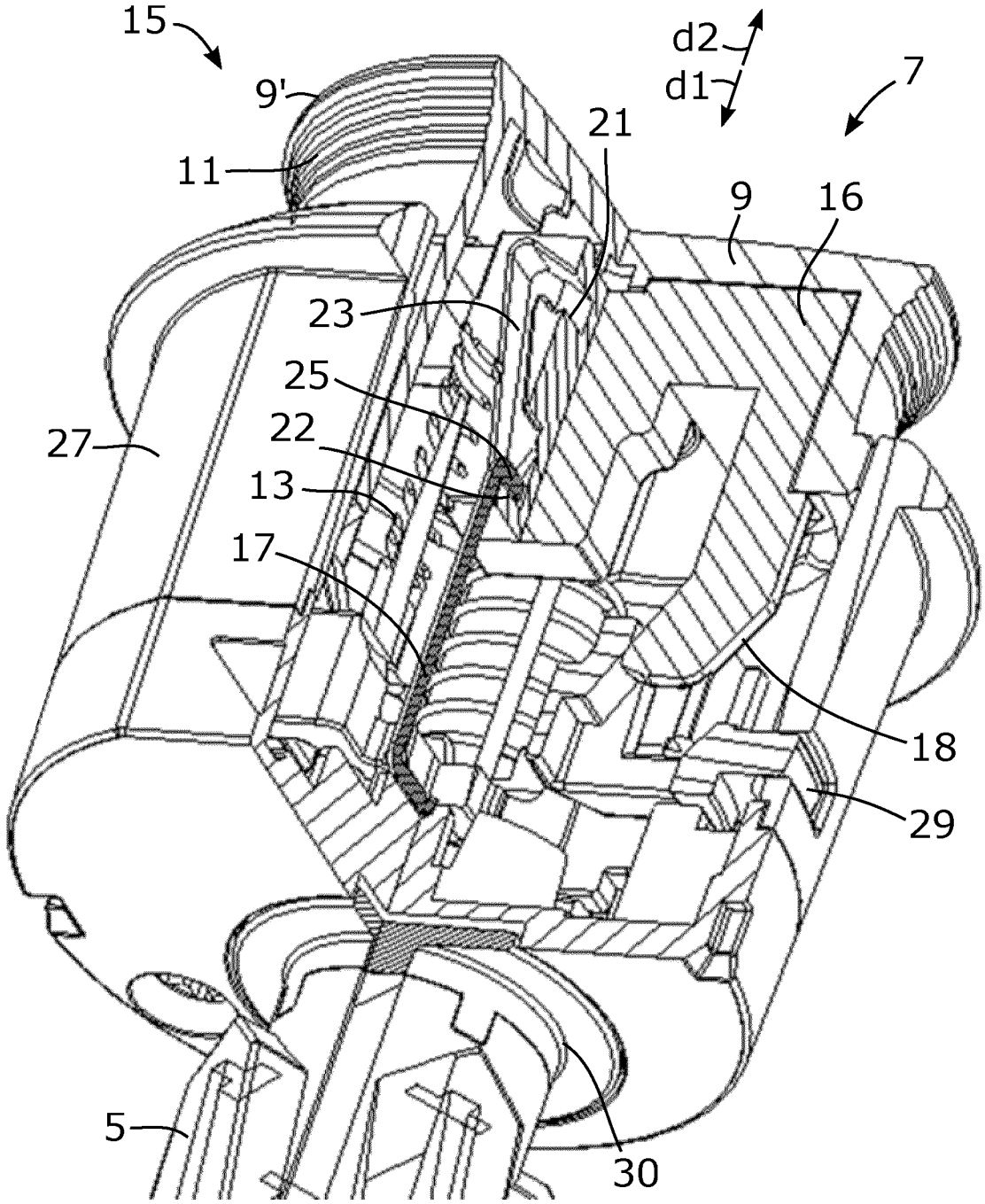
FIG. 6 illustrates the brush roll unit illustrated in FIG. 5 with the locking assembly illustrated in the unlocked state and the button illustrated in a second position.

FIG. 6 illustrates the brush roll unit 15 illustrated in FIG. 5 with the locking assembly 7 illustrated in the unlocked state and the button 9 illustrated in the second position. As can been seen in FIG. 6, as a result of the displacement of the button 9 in the first direction d1 and of the biasing force of the spring member 13, the cam profile 23 has moved the follower portion 25 of the second lock member 17 from the first seat 21 to the second seat 22. When the button 9 is in the second position, the biasing force of the spring member 13 ensures an abutting contact between the follower portion 25 and the second seat 22 as long as no force is applied onto the button 9 in the first direction d1 overcoming the biasing force of the spring member 13. The second seat 22 is located further from a top surface of the button 9 than the first seat 21 seen in the first direction d1. In this manner, the button 9 protrudes in the second direction d2 out from the housing 27 when the button 9 is in the second position, as illustrated in FIG. 6.

According to further embodiments of the present disclosure, the second lock member 17, as referred to herein, may comprise the first seat 21, the second seat 22 and the cam profile 23. According to such embodiments, the first lock member 16, as referred to herein, may comprise the follower portion 25 received in the cam profile 23.

Moreover, as can be seen in FIG. 5 and FIG. 6, the locking assembly 7 comprises a number of locking elements 29. The locking elements 29 are configured to protrude out from the housing 27 when the locking assembly 7 is in the locked state, as is illustrated in FIG. 5. The locking elements 29 are configured to be displaced into the housing 27 when the locking assembly 7 is in the unlocked state, as is illustrated in FIG. 6. According to the illustrated embodiments, the locking elements 29 are biased in directions into the housing 27. As is indicated in FIG. 5 and FIG. 6, according to the illustrated embodiments, the first lock member 16 comprises an inclined surface 18. When the button 9 is in the second position, as is illustrated in FIG. 6, and the button 9 is displaced in the first direction d1 towards the first position, the inclined surface 18 presses the locking elements 29 out of the housing 27 to positions illustrated in FIG. 5. Likewise, when the button 9 is displaced from the first position towards the second position in the second direction d2 by the biasing force of the spring member 13, the inclined surface 18 gets free from the locking elements 29 and the locking elements 29 are displaced into the housing 27 to the positions illustrated in FIG. 6.

As can be seen in FIG. 1, the opening 31 of the nozzle body 3 comprises a number of apertures 33. The apertures 33 are each configured to accommodate a locking element 29 of the locking assembly 7 when the housing 27 is inserted in the opening 31 and the locking assembly 7 is in the locked state.

When the button 9 is in the second position and the button 9 is moved towards the first position in the first direction d1, the cam profile 23 will move the follower portion 25 of the second lock member 17 from the second seat 22 to the first seat 21. That is, according to the illustrated embodiments, the cam profile 23 is configured to move the follower portion 25 from the second seat 22 to the first seat 21 when the locking assembly 7 is in the unlocked state and the button 9 is displaced in the first direction d1.

Accordingly, the locking assembly 7 according to the illustrated embodiments can be defined as a bi-stable system configured to alternate between the locked state and the unlocked state upon displacements of the button 9 in the first direction d1.

Figure 7:
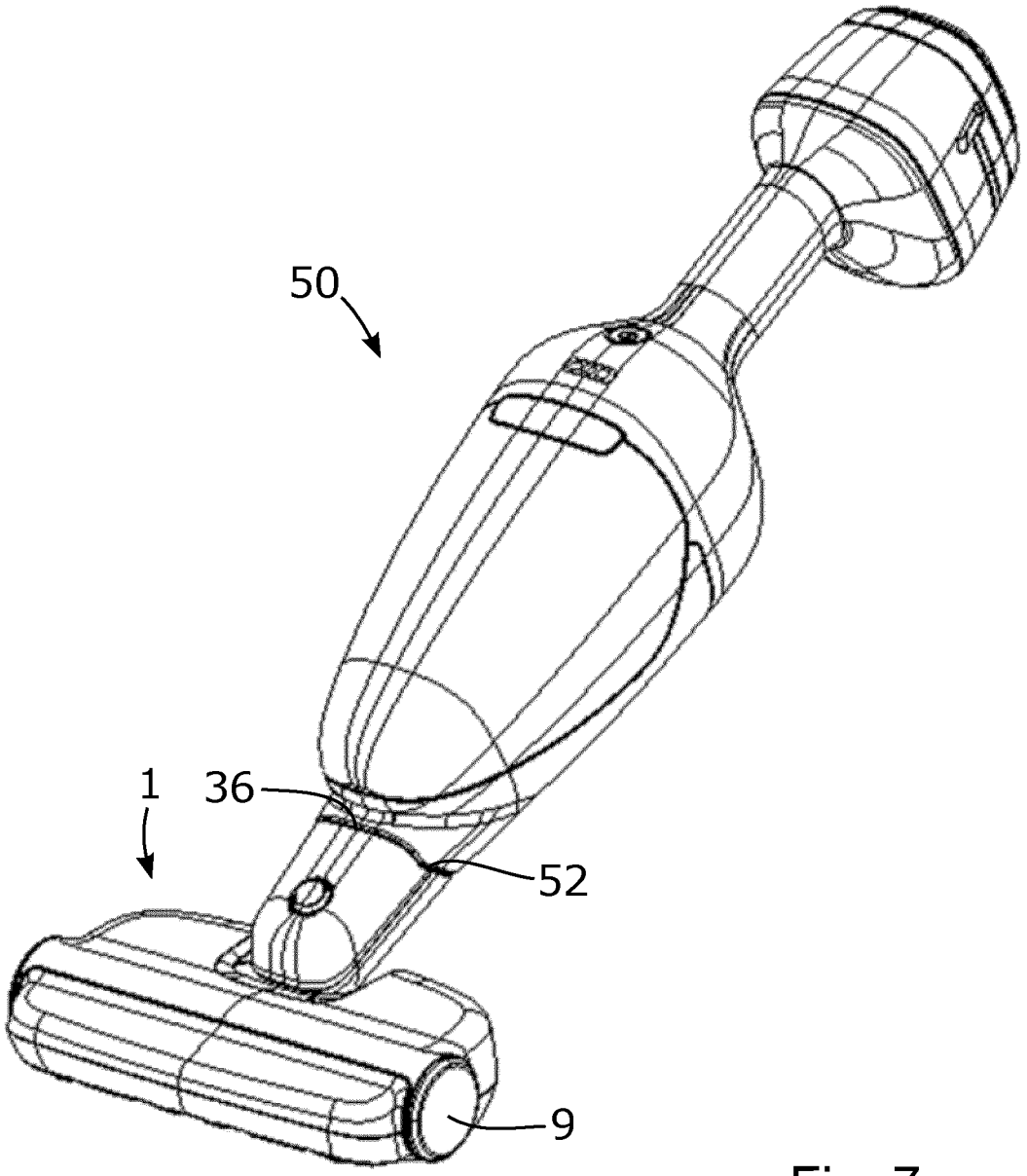
FIG. 7 illustrates a vacuum cleaner according to some embodiments of the present disclosure.

FIG. 7 illustrates a vacuum cleaner 50 according to some embodiments of the present disclosure. The vacuum cleaner 50 comprises a vacuum cleaner nozzle 1 according to the embodiments illustrated in FIG. 1-FIG. 3. The vacuum cleaner nozzle 1 is connected to a suction inlet 52 of the vacuum cleaner 50 via a connection interface 36 of the vacuum cleaner nozzle 1. The connection interface 36 of the vacuum cleaner nozzle 1 is also indicated in FIG. 1-FIG. 3. According to the illustrated embodiments, the vacuum cleaner 50 is a battery powered hand-held vacuum cleaner 50. According to further embodiments, the vacuum cleaner, as referred to herein, may be another type of vacuum cleaner, such as a stick-type vacuum cleaner, a canister vacuum cleaner, or the like.

The vacuum cleaner 50 comprises a fan, a particle separator, and a motor configured to power the fan so as to create a partial vacuum at the vacuum cleaner nozzle 1. Matter, such as particles, dust, hair, and dirt is collected in the particle separator for later disposal. The particle separator may comprise a dust bag, a cyclone, or the like. The fan, the particle separator, and the motor are not illustrated or indicated in FIG. 7 for the reason of brevity and clarity.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims.

The wording "substantially parallel to", as used herein, may encompass that the angle between the objects referred to is less than 7 degrees.

As used herein, the term "comprising" or "comprises" is open-ended, and includes one or more stated features, elements, steps, components, or functions but does not preclude the presence or addition of one or more other features, elements, steps, components, functions, or groups thereof.

The invention claimed is:

1. A vacuum cleaner nozzle comprising:

a nozzle body, a brush roll configured to rotate relative to the nozzle body during operation of the nozzle, a locking assembly having a locked state, in which the locking assembly locks the brush roll to the nozzle body, and an unlocked state, in which the locking assembly unlocks the brush roll from the nozzle body for removal of the brush roll from the nozzle body, wherein the nozzle comprises a button operably connected to the locking assembly, wherein the locking assembly is configured to, when in the locked state, assume the unlocked state after a displacement of the button in a first direction, and when in the unlocked state, assume the locked state after a displacement of the button in the first direction, wherein the button is configured to assume a first position relative to the locking assembly when the locking assembly is in the locked state and a second position relative to the locking assembly when the locking assembly is in the unlocked state, and wherein the first and second positions represent different spatial positions relative to the locking assembly .

2. The nozzle according to claim 1, wherein the button is located further out from the nozzle body in a second direction opposite to the first direction when the button is in the second position than when the button is in the first position.

3. The nozzle according to claim 2, wherein the button comprises a grip surface exposed to a user when the button is in the second position.

4. The nozzle according to claim 1, wherein the locking assembly comprises a spring member configured to bias the button in a second direction opposite to the first direction.

5. The nozzle according to claim 1, wherein the locking assembly comprises a first lock member and a second lock member, wherein the button is operably connected to one of the first and second lock members, and wherein the first lock member is configured to assume a different position relative to the second lock member after a displacement of the button in the first direction.

6. The nozzle according to claim 5, wherein the first lock member comprises a first seat, a second seat and a cam profile, wherein the second lock member comprises a follower portion received in the cam profile, and wherein the cam profile is configured to move the follower portion from the first seat to the second seat when the locking assembly is in the locked state and the button is displaced in the first direction, and is configured to move the follower portion from the second seat to the first seat when the locking assembly is in the unlocked state and the button is displaced in the first direction.

7. The nozzle according to claim 1, wherein the brush roll is configured to rotate around a rotation axis during operation of the nozzle, and wherein the rotation axis extends through at least a portion of the button.

8. The nozzle according to claim 1, wherein the brush roll is configured to rotate around a rotation axis during operation of the nozzle, and wherein the first direction is substantially parallel to the rotation axis.

9. The nozzle according to claim 1, wherein the nozzle comprises a brush roll unit comprising the brush roll, and wherein the button is arranged on the brush roll unit.

10. The nozzle according to claim 1, wherein the nozzle comprises a brush roll unit, and wherein the brush roll unit comprises the brush roll and a housing accommodating the locking assembly.

11. The nozzle according to claim 10, wherein the locking assembly comprises one or more locking elements configured to protrude from the housing when the locking assembly is in the locked state.

12. The nozzle according to claim 10, wherein the substantially an entire circumference of the button is enclosed by the housing when the button is in the first position.

13. The nozzle according to claim 10, wherein a first end of the brush roll is rotationally attached to the housing.

14. The nozzle according to claim 10, wherein the nozzle body comprises an opening configured to accommodate the housing.

15. The nozzle according to claim 14, wherein the opening comprises one or more apertures each configured to accommodate a respective locking element of the locking assembly when the housing is inserted in the opening and the locking assembly is in the locked state.

16. A vacuum cleaner comprising a suction inlet and a nozzle according to claim 1.

17. The nozzle according to claim 11, wherein the one or more locking elements are configured to protrude in a direction perpendicular to the first direction when the locking assembly is in the locked state.

18. The nozzle according to claim 15, wherein each respective locking element of the locking assembly is configured to move in a direction perpendicular to the first direction into the respective aperture when the locking assembly is moved to the locked state.

19. A vacuum cleaner nozzle comprising:

a nozzle body, a brush roll configured to rotate relative to the nozzle body during operation of the nozzle, a locking assembly having a locked state, in which the locking assembly locks the brush roll to the nozzle body, and an unlocked state, in which the locking assembly unlocks the brush roll from the nozzle body for removal of the brush roll from the nozzle body, wherein the nozzle comprises a button operably connected to the locking assembly, wherein the locking assembly is configured to, when in the locked state, assume the unlocked state after a displacement of the button in a first direction, when in the unlocked state, assume the locked state after a displacement of the button in the first direction, and wherein the brush roll is configured to rotate around a rotation axis during operation of the nozzle, and wherein the first direction is substantially parallel to the rotation axis.

20. A vacuum cleaner nozzle comprising:

a nozzle body, a brush roll configured to rotate relative to the nozzle body during operation of the nozzle, a locking assembly having a locked state, in which the locking assembly locks the brush roll to the nozzle body, and an unlocked state, in which the locking assembly unlocks the brush roll from the nozzle body for removal of the brush roll from the nozzle body, wherein the nozzle comprises a button operably connected to the locking assembly, wherein the locking assembly is configured to, when in the locked state, assume the unlocked state after a displacement of the button in a first direction, when in the unlocked state, assume the locked state after a displacement of the button in the first direction, and wherein the nozzle comprises a brush roll unit comprising the brush roll, and wherein the button is arranged on the brush roll unit.

* * * * *